US008454009B2

(12) United States Patent
Nagura et al.

(10) Patent No.: US 8,454,009 B2
(45) Date of Patent: Jun. 4, 2013

(54) BILL STORAGE AND HANDLING APPARATUS

(75) Inventors: Akihiro Nagura, Nagakute (JP); Sho Mizuno, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 13/005,314

(22) Filed: Jan. 12, 2011

(65) Prior Publication Data

US 2011/0169210 A1 Jul. 14, 2011

(30) Foreign Application Priority Data

Jan. 13, 2010 (JP) ..... 2010-004520

(51) Int. Cl.
*B65H 31/00* (2006.01)
*B07C 5/00* (2006.01)
*E05G 1/00* (2006.01)

(52) U.S. Cl.
USPC ..... 271/207; 209/534; 109/53

(58) Field of Classification Search
USPC ..... 271/3.01, 3.04, 3.08, 3.14, 180, 181, 271/207; 194/207, 206; 209/534; 902/8–17; 109/22, 23, 24.1, 45–47, 53, 55
See application file for complete search history.

(56) References Cited

U.S. PATENT DOCUMENTS

| | | | | |
|---|---|---|---|---|
| 4,820,909 | A | 4/1989 | Kawauchi et al. | |
| 6,572,013 | B2 * | 6/2003 | Katou et al. | 235/379 |
| 7,249,707 | B2 * | 7/2007 | Yokoi et al. | 235/379 |
| 7,322,518 | B2 * | 1/2008 | Yokoi et al. | 235/379 |
| 7,942,401 | B2 * | 5/2011 | Jeong | 271/3.08 |
| 7,976,005 | B2 * | 7/2011 | Ichikawa et al. | 271/3.01 |
| 2001/0015309 | A1 * | 8/2001 | Ikuta | 194/206 |
| 2004/0135304 | A1 * | 7/2004 | Tokunaga et al. | 271/3.01 |
| 2008/0150216 | A1 * | 6/2008 | Ichikawa et al. | 271/3.01 |
| 2011/0130870 | A1 * | 6/2011 | Aoji et al. | 700/218 |

FOREIGN PATENT DOCUMENTS

| | | |
|---|---|---|
| EP | 1 130 551 A2 | 9/2001 |
| EP | 2 083 400 A1 | 7/2009 |
| GB | 2 225 662 A | 6/1990 |
| GB | 2 345 571 A | 7/2000 |
| JP | 08-221636 | 8/1996 |
| JP | 2008-152430 | 7/2008 |

OTHER PUBLICATIONS

European Patent Office extended search report on application No. 11150156.5 dated Oct. 26, 2011; 8 pages.

* cited by examiner

*Primary Examiner* — Patrick Cicchino
(74) *Attorney, Agent, or Firm* — Foley & Lardner LLP

(57) ABSTRACT

A bill storage comprises: a plurality of bill receipt portions provided therein; a bill inlet-outlet, which is provided on an upper surface of the bill storage and through which bills are taken out or received from outside; and a taking-out and accumulating mechanism part provided on each of the receipt portions to perform actions, in which bills are taken out and in which bills are accumulated, wherein at least a first bill receipt portion and a second bill receipt portion are arranged in a state of being stacked in this order from a side of the bill inlet-outlet, the bill inlet-outlet is provided on a predetermined side, and the taking-out and accumulating mechanism part provided on the first bill receipt portion is arranged on another side opposed to the predetermined side.

10 Claims, 18 Drawing Sheets

BILL STORAGE AND HANDLING APPARATUS

The present application claims priority from Japanese application JP 2010-004520 filed on Jan. 13, 2010, the content of which is hereby incorporated by reference into this application.

BACKGROUND OF THE INVENTION

The present invention relates to a bill handling apparatus installed in an automatic teller machine (ATM) mounted in, for example, a financial institution or the like, and a bill storage mounted in the bill handling apparatus.

Conventionally, a bill handling apparatus is installed in an automatic teller machine used in a financial institution or the like. Such bill handling apparatus comprises a bill receipt/payment port, through which a user charges and takes out a bill, a bill discrimination unit, which discriminates a bill being received or paid, a temporary holding box, which temporarily receives a bill as received until an associated transaction is realized, a bill storage, which receives and holds a bill, and a bill conveyance path, through which a bill is conveyed to the respective units or boxes.

The bill storage includes a reject box for receipt of rejected bill, which is discriminated by the bill discrimination unit not to meet a predetermined reference, a recycling box, in which bill for receipt and payment is received every denomination, and a loading box, which serves for replenishing of bill to the recycling box and for recovery of bill from the recycling box.

Recently; as cash handled in an ATM is increased in denomination, there is proposed a bill handling apparatus, in which many bill storages are mounted to the extent possible. In a bill handling apparatus described in JP-A-8-221636, for example, plural bill storages are arranged in a lower portion of the apparatus in alignment in a longitudinal direction of the apparatus, and a bill receipt/payment port, a bill discrimination unit, a temporary holding box, and other mechanism parts are arranged together in an upper portion of the apparatus.

Denominations, which a bill handling apparatus can handle, correspond to the number of the bill storages. That is, as the number of the bill storages is increased, it is possible to handle many denominations. In case of the bill handling apparatus described in JP-A-8-221636, however, the bill handling apparatus is made large-sized in a longitudinal direction corresponding to the number of bill storages. Therefore, there has been demanded for a bill handling apparatus capable of corresponding to an increase in denomination while the apparatus is prevented from being made large-sized.

Meeting the demand described above, a bill storage provided therein with a plurality of receipt portions has been proposed as shown in JP-A-2008-152430. In the bill storage described in JP-A-2008-152430, it becomes possible to handle a plurality of denominations only by one bill storage. Therefore, without the extension of bill storages, it becomes possible to provide a bill handling apparatus capable of corresponding to an increase in denomination.

The bill storage disclosed in JP-A-2008-152430 comprises a bill inlet-outlet, through which a bill is taken out or received from the outside, a sorting gate, which switches connection of a conveyance path in order to distribute bills to destinations of conveyance, and a plurality of receipt portions including a taking-out and accumulating mechanism part (a feed roller, gate roller, etc.), which performs actions, in which bill is taken out and in which bill is accumulated. In the bill storage, an internal conveyance path, through which a bill is conveyed in a vertical direction of the bill storage, and a sorting gate, which distributes bills to destinations of receipt, and the sorting gate and the taking-out and accumulating mechanism part are arranged adjacent to each other in this order from the bill inlet-outlet.

That is, since the mechanism part is concentrated in the vicinity between the bill inlet-outlet and the receipt portions, the storage is increased in dimension in a longitudinal direction. Therefore, there has been a demand for realization of a bill storage provided therein with a plurality of receipt portions while the apparatus is prevented from becoming large in size.

SUMMARY OF THE INVENTION

Meeting the demand described above, it is an object of the invention to miniaturize a bill storage provided therein with a plurality of receipt portions. Concretely, while a taking-out and accumulating mechanism part provided in a receipt portion nearest to a bill inlet-outlet and a sorting gate for switching of conveyance of bill are conventionally arranged adjacent to each other, the taking-out and accumulating mechanism part and the sorting gate are arranged separately.

According to the invention, it becomes possible to decrease a space between the sorting gate and the receipt portions. Therefore, a width of the bill storage, which has a plurality of receipt portions therein, in a longitudinal direction can be made as substantially small as that of a bill storage provided therein with a single receipt portion, which stores therein only one denomination.

Also, it becomes possible to optionally select and mount a bill storage, which has a plurality of receipt portions therein, or a bill storage, which has a single receipt portion therein, without a change in construction of the bill handling apparatus. Therefore, it becomes possible to provide a bill handling apparatus capable of flexibly accommodating an increase in denomination.

Other objects, features and advantages of the invention will become apparent from the following description of the embodiments of the invention taken in conjunction with the accompanying drawings.

DETAILED DESCRIPTION OF THE INVENTION

An embodiment of the invention will be described with reference to the drawings.

Figure 1:
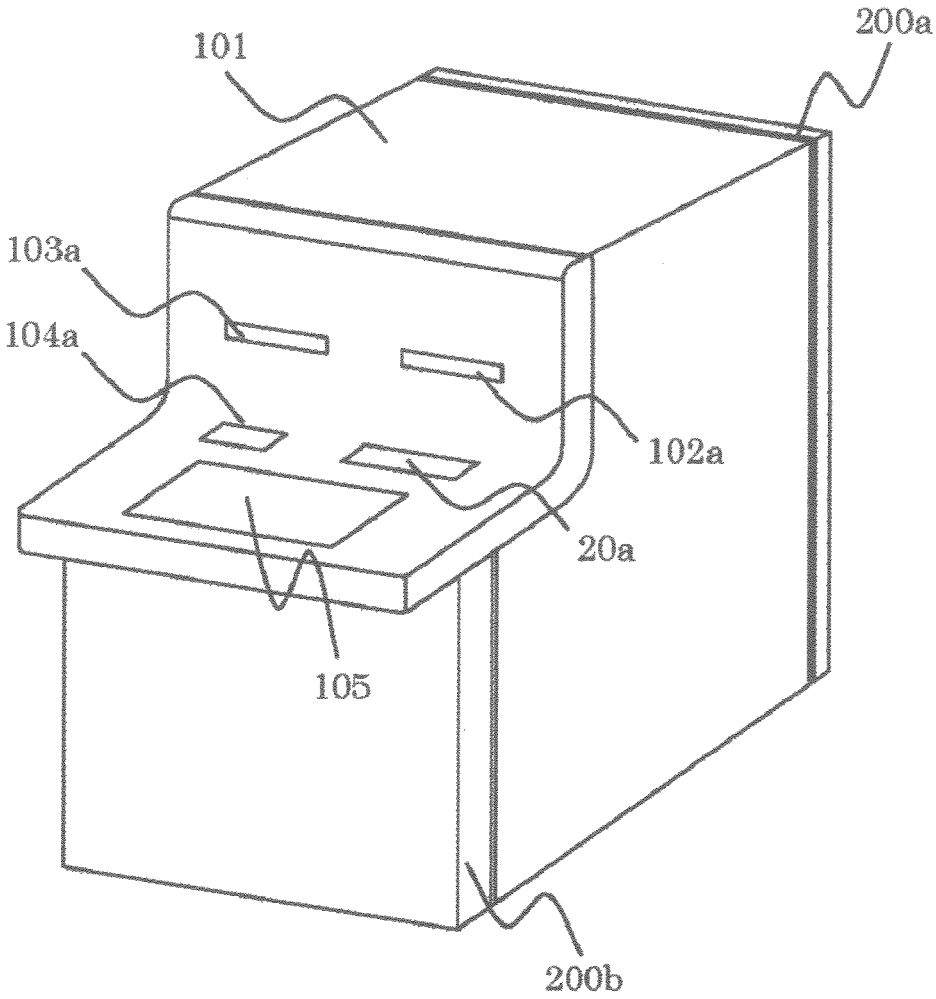
FIG. 1 is a perspective view showing an outline of an ATM as viewed from a front side thereof.
Figure 2:
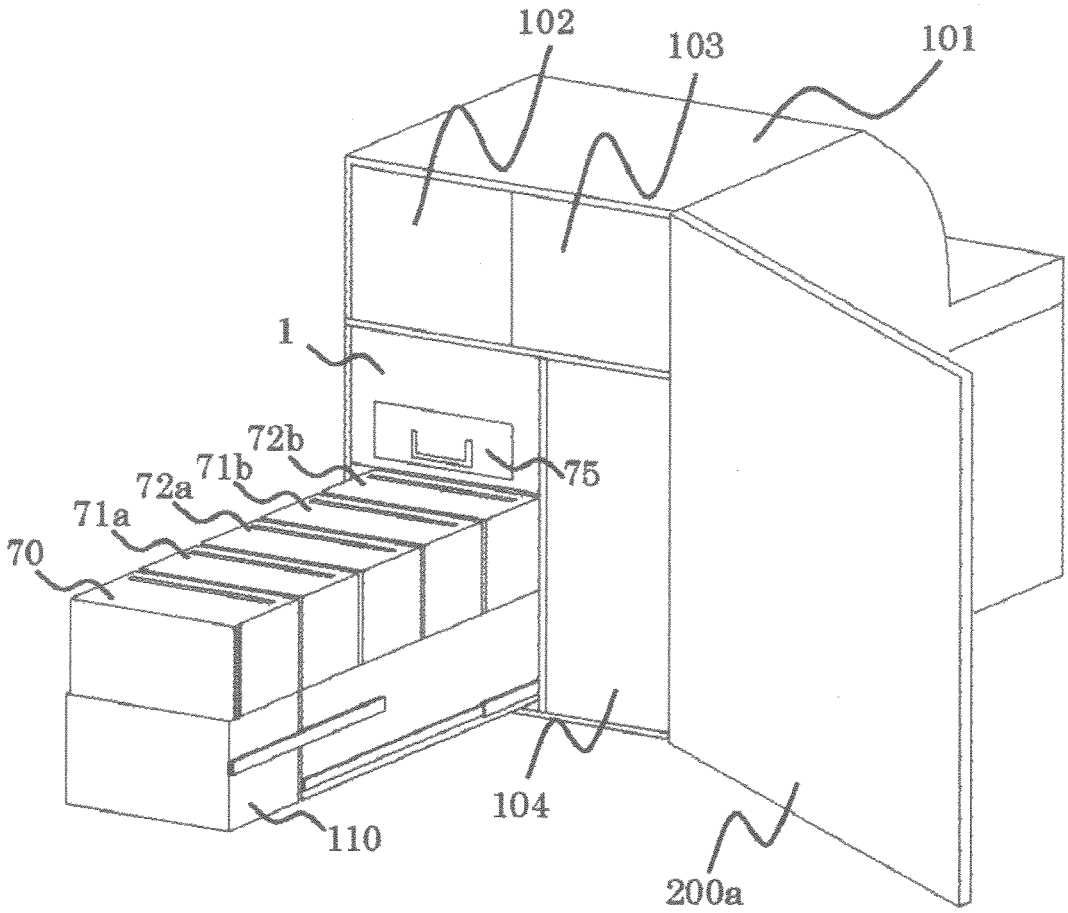
FIG. 2 is a perspective view showing the outline of the ATM as viewed from a back side thereof.

FIGS. 1 and 2, respectively, are perspective views showing an outline of an ATM as viewed from front and back sides thereof.

A card and account-slip processing device 102 is provided in an upper, right interior of an ATM 101 to be communicated with a card slot 102*a* to transact a user's card to print and discharge a transaction detail slip. A passbook transaction device 103 is provided in an upper, left interior of the ATM 101 to be communicated with a passbook slot 103*a* to transact a user's passbook to print and discharge a transaction detail slip.

Also, a bill handling apparatus 1 is provided in a lower, right interior of the ATM 101 to handle bills. The bill handling apparatus 1 is communicated with a bill receipt/payment port shutter 20*a*, through which a user charges and takes out bills and bill receipt and payment transactions are processed. A coin handling apparatus 104 is provided in a lower, left interior of the ATM 101 to handle coins. The coin handling apparatus 104 is communicated with a coin receipt/payment port shutter 104*a* to process coin receipt and payment transactions. In addition, the ATM 101 may be one with which the coin handling apparatus 104 is not provided.

Also, a customer operation unit 105 to display and input contents of a transaction is provided on the front of the ATM 101.

The bill handling apparatus 1 is provided with a tray 110 in a lower portion thereof as a portion, to which bill storages are mounted. Bill storages 70, 71*a*, 71*b*, 72*a*, 72*b* arranged in a row in a longitudinal direction of the ATM 101 are mounted detachably on the tray 110. In addition, while FIG. 2 shows a construction, in which a door 200*a* on the rear is opened to permit the tray 110 to be pulled out, a construction, in which a door 200*b* on the front is opened to permit the tray 110 to be pulled out, may apply.

Figure 3:
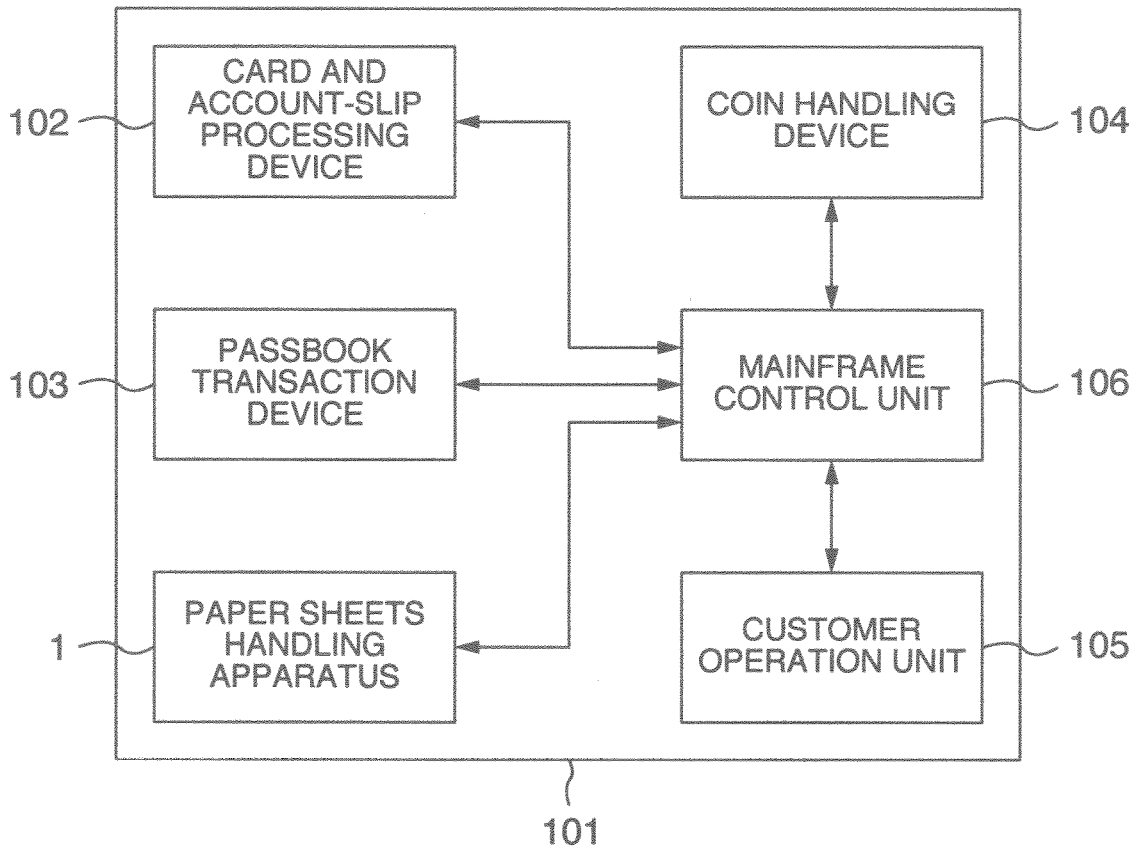
FIG. 3 is a control block diagram showing the control relationship of the ATM.

FIG. 3 is a control block diagram showing a control relationship of the ATM 101.

The ATM 101 comprises the card and account-slip processing device 102, the passbook transaction device 103, the bill receipt/payment machine 1, the coin handling apparatus 104, the customer operation unit 105, and a mainframe control unit 106. The card and account-slip processing device 102, the passbook transaction device 103, the bill receipt/payment machine 1, the coin handling apparatus 104, and the customer operation unit 105 perform necessary actions under the control of the mainframe control unit 106.

Figure 4:
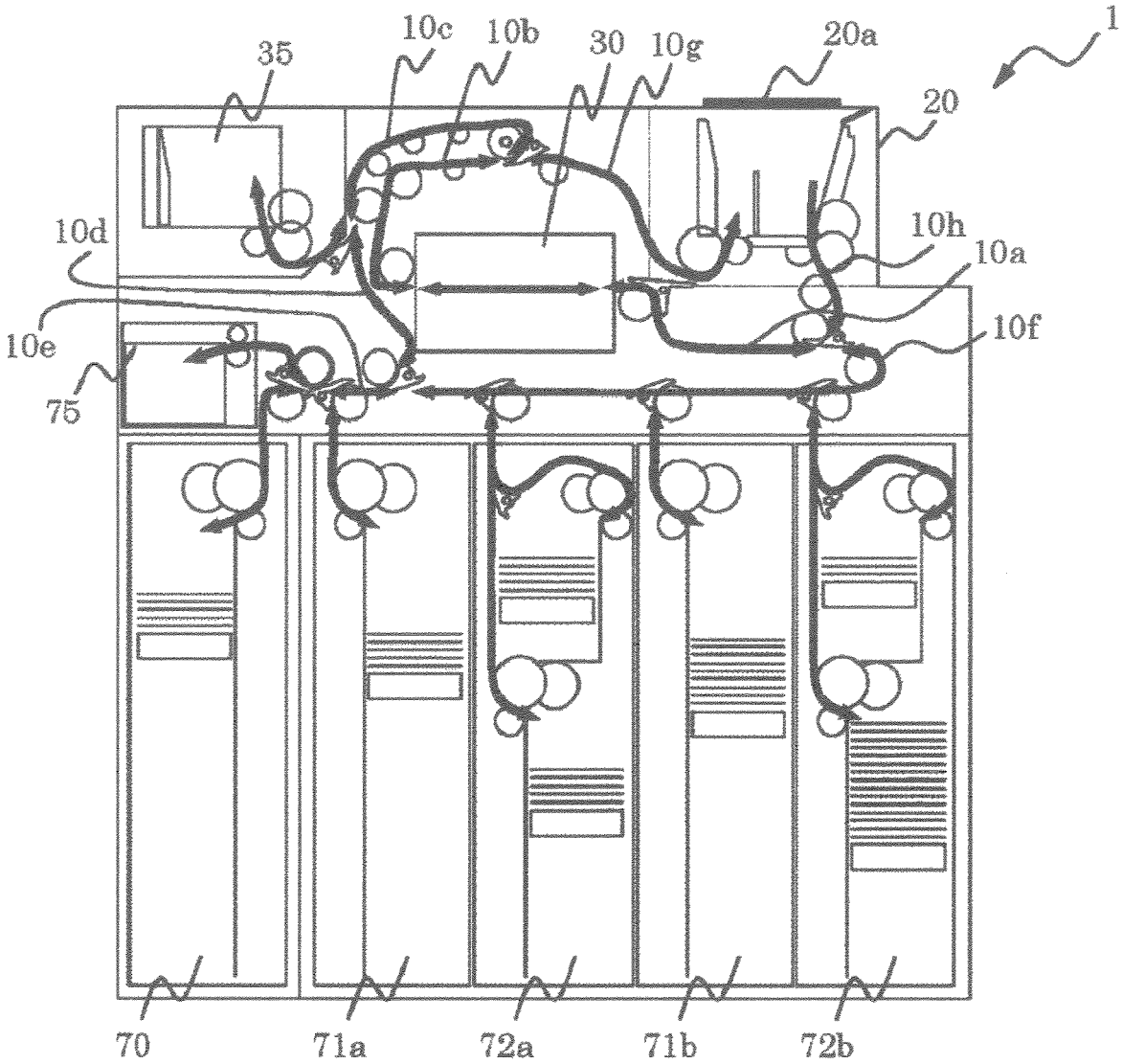
FIG. 4 is a view showing an internal construction of a bill handling apparatus.

FIG. 4 is a side view shorting an internal construction of the bill handling apparatus 1.

A bill receipt/payment port 20 is arranged on the front side (a side facing a user: an upper, right side in FIG. 4) of an upper portion of the bill handling apparatus 1. Also, a bill discrimination unit 30, which discriminates bills being received or taken out is arranged centrally of the bill handling apparatus 1 and a temporary holding box 35, which temporarily receives bills as received until realization of an associated transaction is arranged on an upper portion of the back side (an opposite side to the front side: an upper, left side in FIG. 4) of the bill handling apparatus 1. A reject box 75, which stores bills not presented to receipt and payment transactions, or bills left behind a customer is arranged below the temporary holding box 35. These mechanisms are connected together by two-way conveyance paths 10*a* to 10*f*, through which bills are conveyed two-way, and one-way conveyance paths 10*g*, 10*h*, through which bills are conveyed one-way.

Here, the bill discrimination unit 30 can discriminate denomination and truth or falsehood of both bills conveyed toward the rear from the front and bills conveyed toward the front from the rear. That is, the bill discrimination unit 30 can discriminate denomination and truth or falsehood of bills conveyed two-way and can determine whether bills should be rejected or not.

Bill storages 72*b*, 71*b*, 72*a*, 71*a*, which store bills, and a loading box 70, which performs loading and recovery of bills into the bill storages to function as a bill loading part are arranged from the front toward the rear in a lower portion of the bill handling apparatus 1. The bill storage 71 (71*a* and 71*b*) is one having a single receipt portion, which stores therein only one denomination. On the other hand, the bill storage 72 (72*a* and 72*b*) is one having two receipt portions therein.

Figure 5:
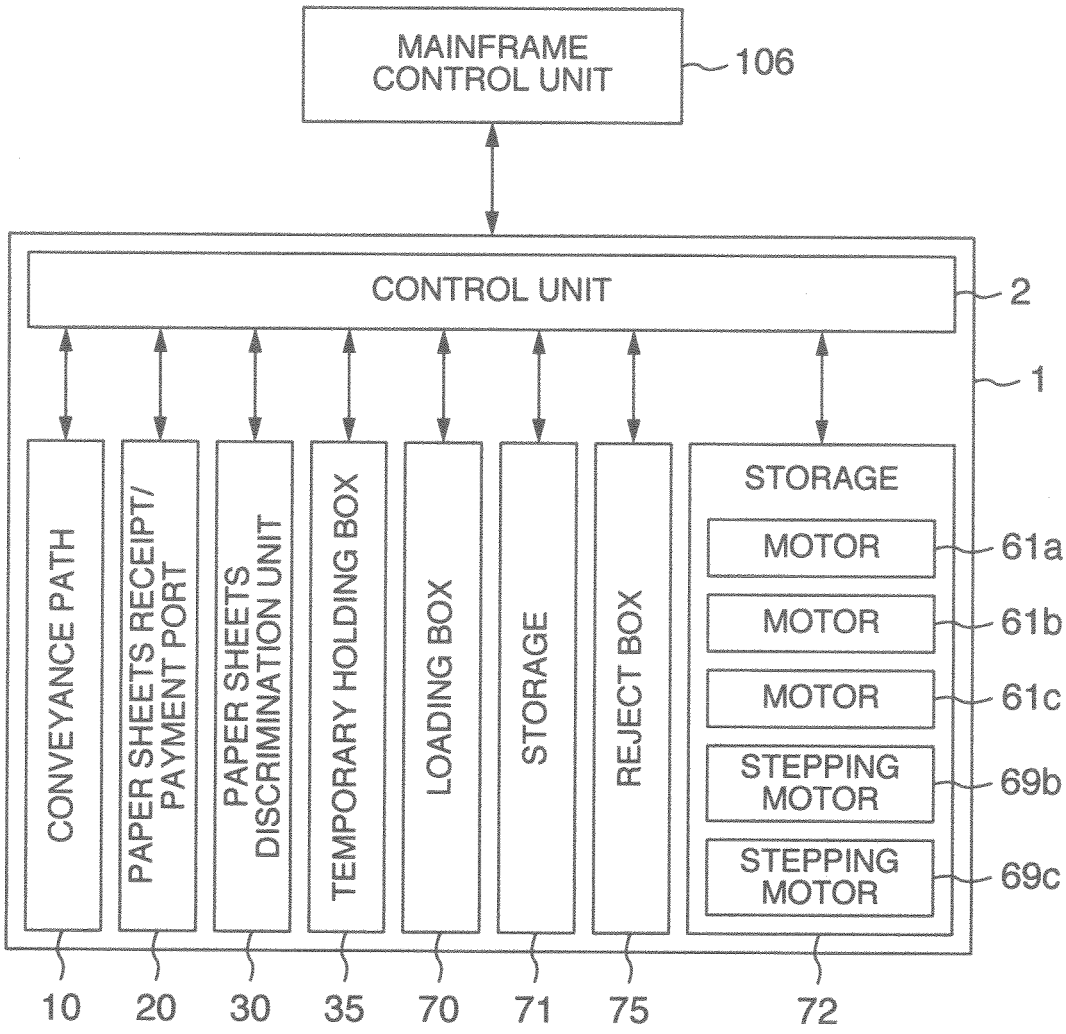
FIG. 5 is a control block diagram showing the control relationship of the bill handling apparatus.

FIG. 5 is a control block diagram showing control relationship of the bill handling apparatus 1.

A control unit 2 of the bill handling apparatus 1 is connected to the mainframe control unit 106 of the ATM 101 to control the bill handling apparatus 1 according to a command from the mainframe control unit 106 and detection of a state of the bill handling apparatus 1. Also, the control unit 2 forwards the state of the bill handling apparatus 1 to the mainframe control unit 106 at need.

The bill handling apparatus 1 includes motors, solenoids, sensors, or the like for driving of the respective units (a conveyance path 10, the bill receipt/payment port 20, the bill discrimination unit 30, the temporary holding box 35, the loading box 70, the bill storages 71, 72, the reject box 75) and drivingly controls motors, solenoids, or the like while monitoring states of the units with the use of the sensors. In particular, the bill storage 72 having two receipt portions therein includes motors 61*a* to 61*c* serving as drive sources for conveyance, receiving and taking-out, or the like of bill and stepping motors 69*b*, 69*c* for actuation of the storage mechanisms, and the two receipt portions, respectively, can act independently.

The bill handling apparatus 1 constructed in the manner described above can carry out bill receipt and payment transactions.

Hereinafter, a case where the bill storages 71 and 72 are applied as recycling boxes for storage of bill for receipt and payment will be described. In addition, the bill storages 71 and 72 may be applied as the reject boxes described above or loading boxes.

First, actions of the bill storage 71 having a single receipt portion therein will be described.

Figure 6:
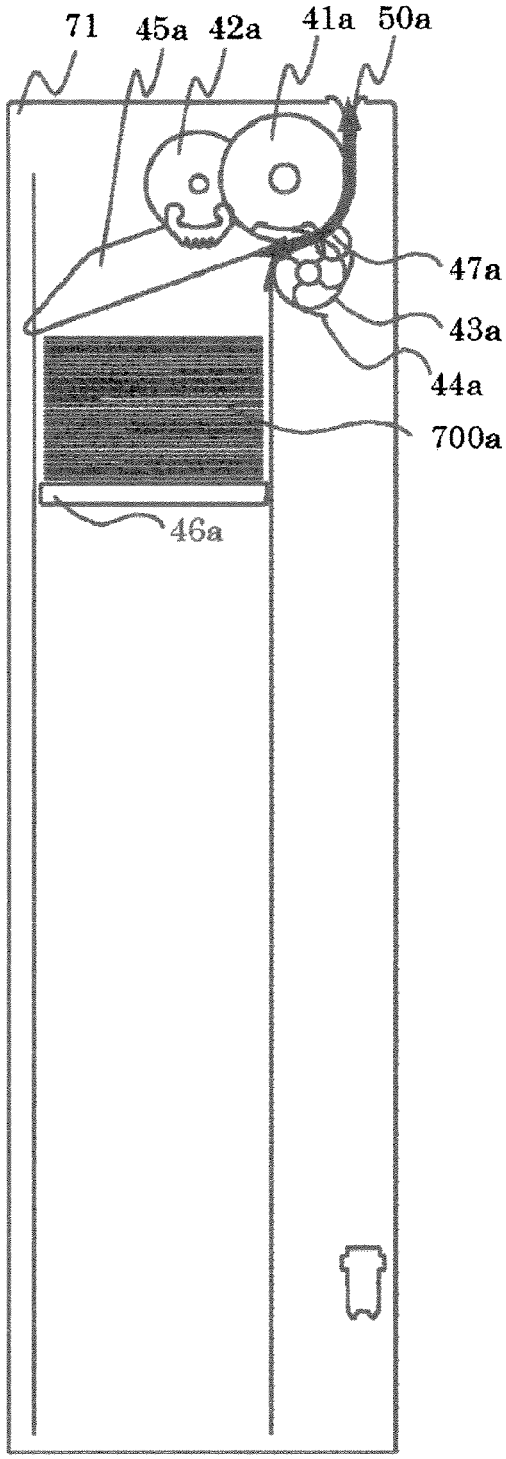
FIG. 6 is a side view showing a bill storage having a single receipt portion therein.

FIG. 6 is a view showing the bill storage 71 having a single receipt portion therein. The bill storage 71 includes a receipt portion 700*a*, which includes a taking-out and accumulating mechanism part, a push plate 46*a*, a pinch roller 47*a*, and a bill inlet-outlet 50*a*, which is provided on an upper surface of the bill storage near to a front surface thereof to transfer bills to an outside conveyance path.

A taking-out and accumulating mechanism part provided in the receipt portion 700*a* comprises a feed roller 41*a*, which rotates at a bill accumulating action and at a bill taking-out action to convey bills, a pick-up roller 42*a*, a gate roller 43*a*, which rotates at the bill accumulating action but does not rotate at the bill taking-out action, a brush roller 44*a* provided coaxially with the gate roller and having elastic members arranged radially, and a stack guide 45*a* movable at the bill accumulating action and at the bill taking-out action.

In addition, when the bill storage 71 functions only to accumulate bills, it may be constructed without the provision of the pick-up roller 42*a*. On the other hand, when the bill storage 71 functions only to take out bills, it may be constructed without the provision of the stack guide 45*a*.

Figure 7:
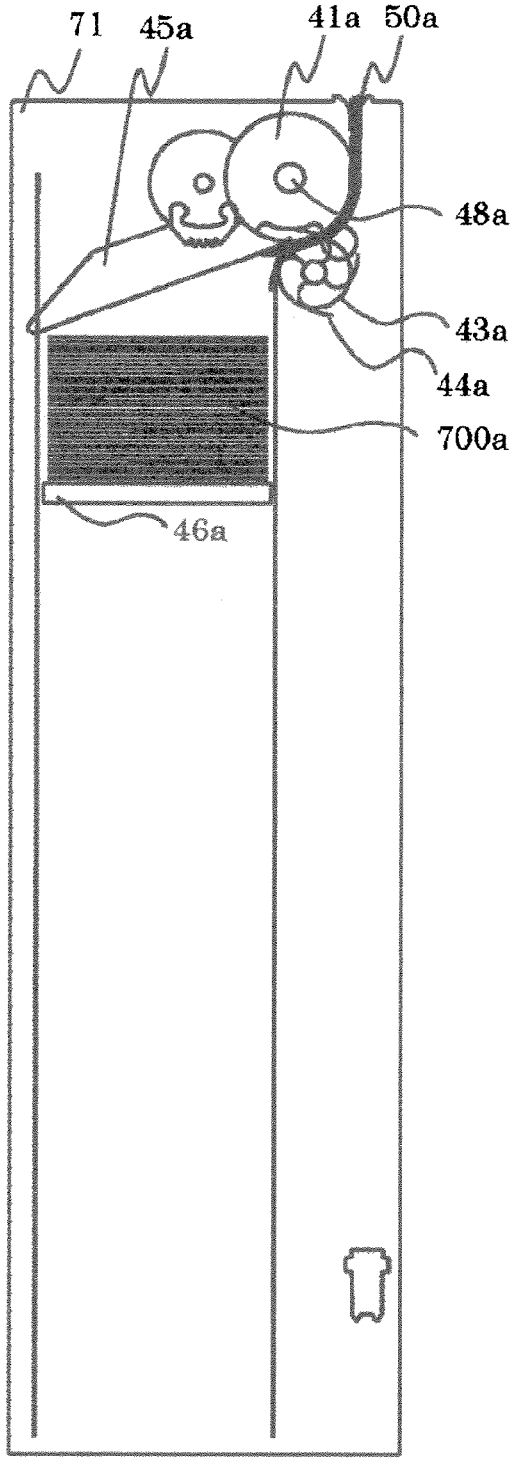
FIG. 7 is a side view showing an action, in which bills are accumulated in the receipt portion.

FIG. 7 is a view showing an action, in which bills are accumulated in the receipt portion 700*a*.

Bills conveyed into the bill storage 71 through the bill inlet-outlet 50*a* are discharged into the receipt portion 700*a* as the feed roller 41*a* and the gate roller 43*a* rotate.

Here, before bills are discharged into the receipt portion 700*a*, the push plate 46*a* is moved by a driving force of a stepping motor (not shown). The push plate 46*a* is controlled in moving in a direction, in which bills as stored descend, so as to ensure a space in the receipt portion. Subsequently, the stack guide 45*a* rotates pivotally about a feed roller shaft 48*a* and so the stack guide 45*a* is moved slantwise. The stack guide 45*a* is moved slantwise whereby bills discharged into the receipt portion 700*a* move along a slope of the stack guide 45*a*.

Figure 8:
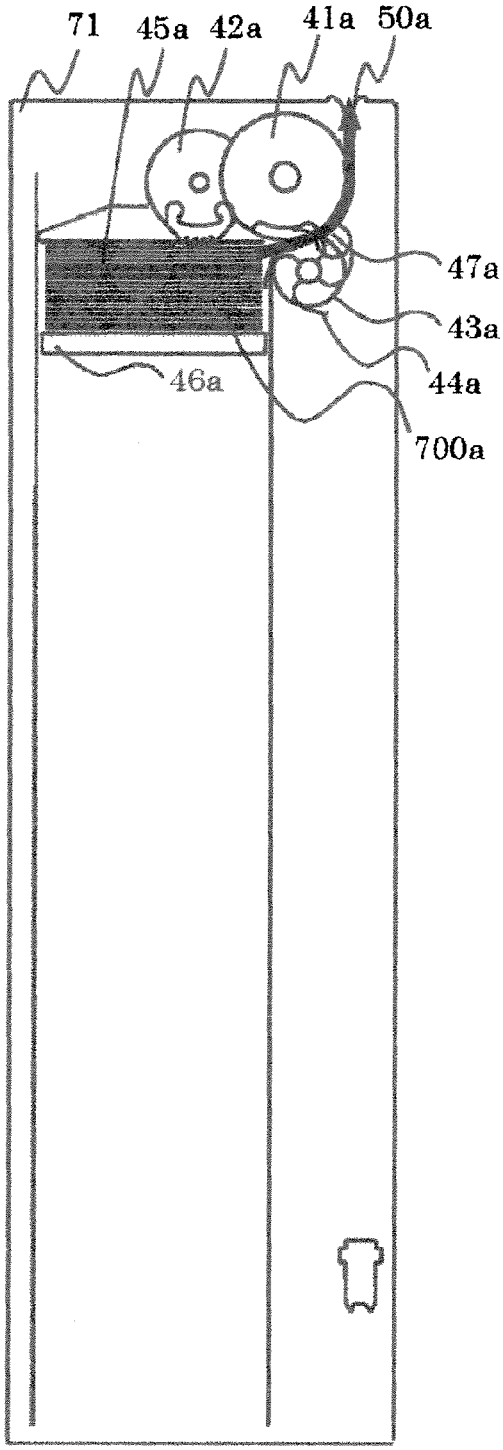
FIG. 8 is a side view showing an action, an which bills are taken out of the receipt portion.

FIG. 8 is a view showing an action, in which bills are taken out of the receipt portion 700*a*.

The push plate 46*a* is moved upward by the driving force of the stepping motor (not shown). The push plate 46*a* is moved upward and so a force of a spring (not shown) or the like has bills on the stack guide 45*a* pushed against the pick-up roller 42*a* with a predetermined push force. In addition, while the case where the push plate 46*a* pushes bills has been described, a construction will do, in which the pick-up roller 42*a* pushes bills.

As described above, in a state, in which a push force acts between the pick-up roller 42*a* and bills, the pick-up roller 42*a* rotates whereby a bill in contact with the pick-up roller 42*a* can be taken out of the receipt portion 700*a*. Bills taken out of the receipt portion 700*a* are forwarded by the feed roller 41*a*, which rotates, and while the gate roller 43*a*, which does not rotate in a taking-out direction, prevents two sheets of bill from being forwarded at once, bills are conveyed one by one outside the bill storage through the pinch roller 47*a* from the bill inlet-outlet 50*a*. After a predetermined number of bills have been forwarded outside the bill storage, the feed roller 41*a* is stopped.

Subsequently, actions of the bill storage 72 provided therein with two receipt portions will be described.

Figure 9:
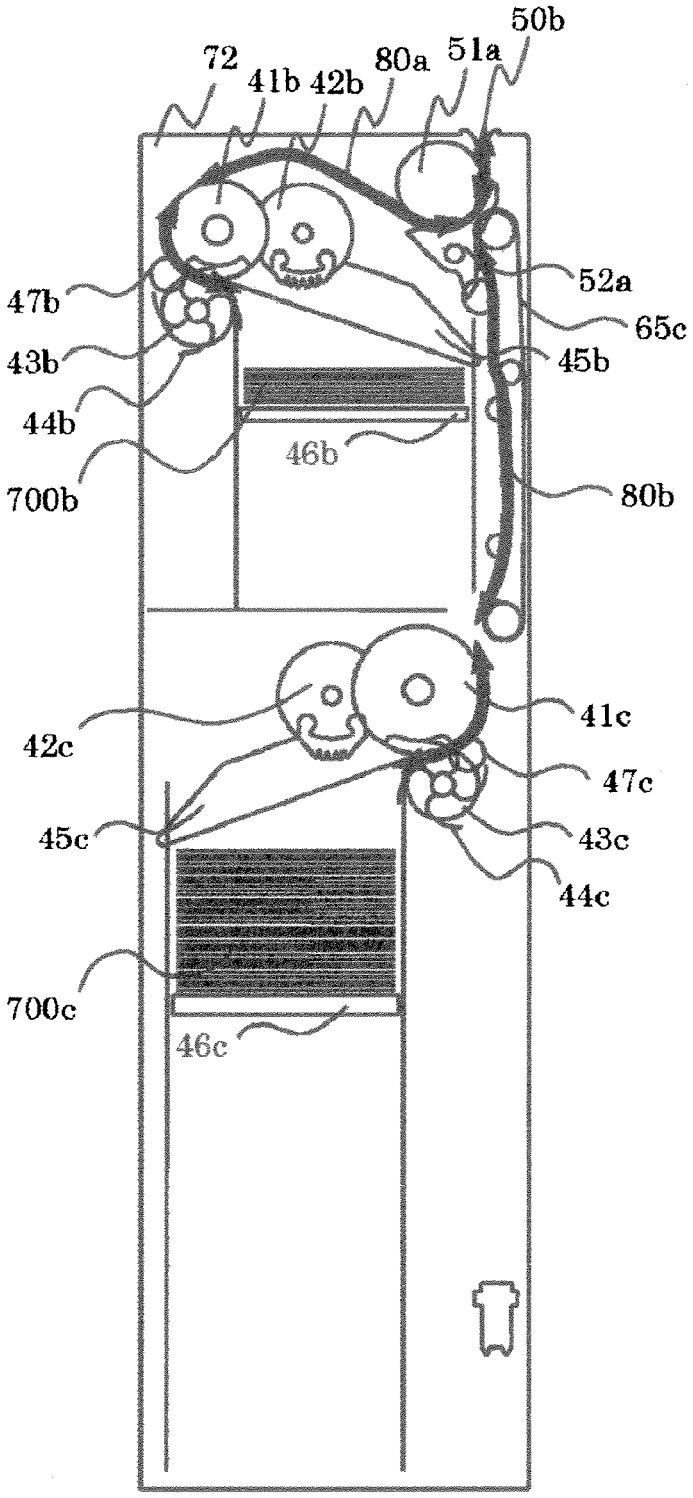
FIG. 9 is a side view showing a bill storage having two receipt portions therein.

FIG. 9 is a view showing the bill storage 72 provided therein with two receipt portions. The bill storage 72 comprises an upper receipt portion 700*b* and a lower receipt portion 700*c*, each of which includes a taking-out and accumulating mechanism part, push plates 46*b*, 46*c*, pinch rollers 47*b*, 47*c*, and a bill inlet-outlet 50*b* provided on an upper surface of the bill storage near to a front surface thereof for performing bill transferring to and from the outside conveyance path. The upper receipt portion 700*b* and the lower receipt portion 700*c* are arranged in a state of being stacked in this order from the neighborhood of the bill inlet-outlet 50*b*.

Like the taking-out and accumulating mechanism part provided in the receipt portion 700*a* of the bill storage 71 provided therein with a single receipt portion, the taking-out and accumulating mechanism parts provided in the respective receipt portions 700 (700*b*, 700*c*) comprise a feed roller 41 (41*b*, 41*c*), a pick-up roller 42 (42*b*, 42*c*), a gate roller 43 (43*b*, 43*c*), a brush roller 44 (44*b*, 44*c*), and a stack guide 45 (45*b*, 45*c*). In particular, the upper receipt portion 700*b* is constructed to permit bills to enter into the receipt portion from a back side (on the left in FIG. 9) of the bill storage 72, and the taking-out and accumulating mechanism part provided in the receipt portion 700*b* is provided on the back side of the bill storage 72.

The bill inlet-outlet 50*b* is an inlet-outlet common to the upper receipt portion 700*b* and the lower receipt portion 700*c*, and a roller 51*a* is provided in a position adjacent to the inlet-outlet 50*b* to take bills into and outside the bill storage. By arranging the roller 51*a*, the feed roller 41*b*, and the gate roller 42*b* substantially in the same level, the upper receipt portion 700*b* is prevented from being decreased in volume.

The bill inlet-outlet 50*b*, the upper receipt portion 700*b*, and the lower receipt portion 700*c* are connected together by means of an internal conveyance path, through which bills can be bi-directionally conveyed. Concretely, the conveyance path comprises an internal conveyance path 80*a*, through which bills are conveyed substantially in a horizontal direction (a longitudinal direction of the bill storage) and an internal conveyance path 80*b*, through which bills are conveyed substantially in a vertical direction (a direction perpendicular to the longitudinal direction of the bill storage). The internal conveyance path 80*b* is constructed such that a width of the conveyance path in the longitudinal direction is made a necessity minimum by an arrangement, in which a driven roller is pushed against a conveyor belt 65*c* arranged on one side to convey bills. Also, a sorting gate 52*a* serving to distribute bills to the internal conveyance path 80*a* or the internal conveyance path 80*b* is arranged just below the roller 51*a*.

In addition, when the bill storage 72 only functions to accumulate bills, it may be constructed without the provision of the pick-up roller 42*a* (42*b*, 42*c*). On the other hand, when the bill storage 72 functions only to take out bills, it may be constructed without the provision of the stack guide 45 (45*b*, 45*c*). Also, when the bill storage 72 functions only to either accumulate or take out bills, the internal conveyance paths 80*a* and 80*b* may comprise a conveyance path, through which bills can be conveyed only one-way.

As shown in FIG. 9, while a taking-out and accumulating mechanism part provided on the upper receipt portion 700*b* is arranged on the back side of the bill storage 72, the bill inlet-outlet 50*b*, the sorting gate 52*a*, and the internal conveyance path 80*b* are arranged on the front side of the bill storage 72. The taking-out and accumulating mechanism part provided on the upper receipt portion 700*b* and the sorting gate 52*a*, respectively, are arranged in separate positions whereby it is made possible to decrease a space between the sorting gate 52*a* and the upper receipt portion 700*b*, thus leading to miniaturization of the bill storage 72. Also, the taking-out and accumulating mechanism part provided on the upper receipt portion 700*b* is arranged on the back side of the bill storage 72 and the bill inlet-outlet 50*b* is arranged on the front side of the bill storage 72 whereby a space just below the sorting gate 52*a* can also be made use of as a portion of a space in the upper receipt portion 700*b*. Therefore, even a bill storage having the sorting gate 52*a* can make efficient use of a space in the bill storage to lead to miniaturization of the bill storage 72.

In addition, as described above, the taking-out and accumulating mechanism part provided on the upper receipt portion 700*b* is arranged on the back side of the bill storage 72 and the space between the sorting gate 52*a* and the upper receipt portion 700*b* is made small, with the result that the upper receipt portion 700*b* is arranged in offset toward the front side of the bill storage 72 (on the right side in FIG. 9). On the other hand, the lower receipt portion 700*c* is arranged offset toward the back side of the bill storage 72 since its taking-out and accumulating mechanism part is provided on the front side of the bill storage 72.

Figure 10:
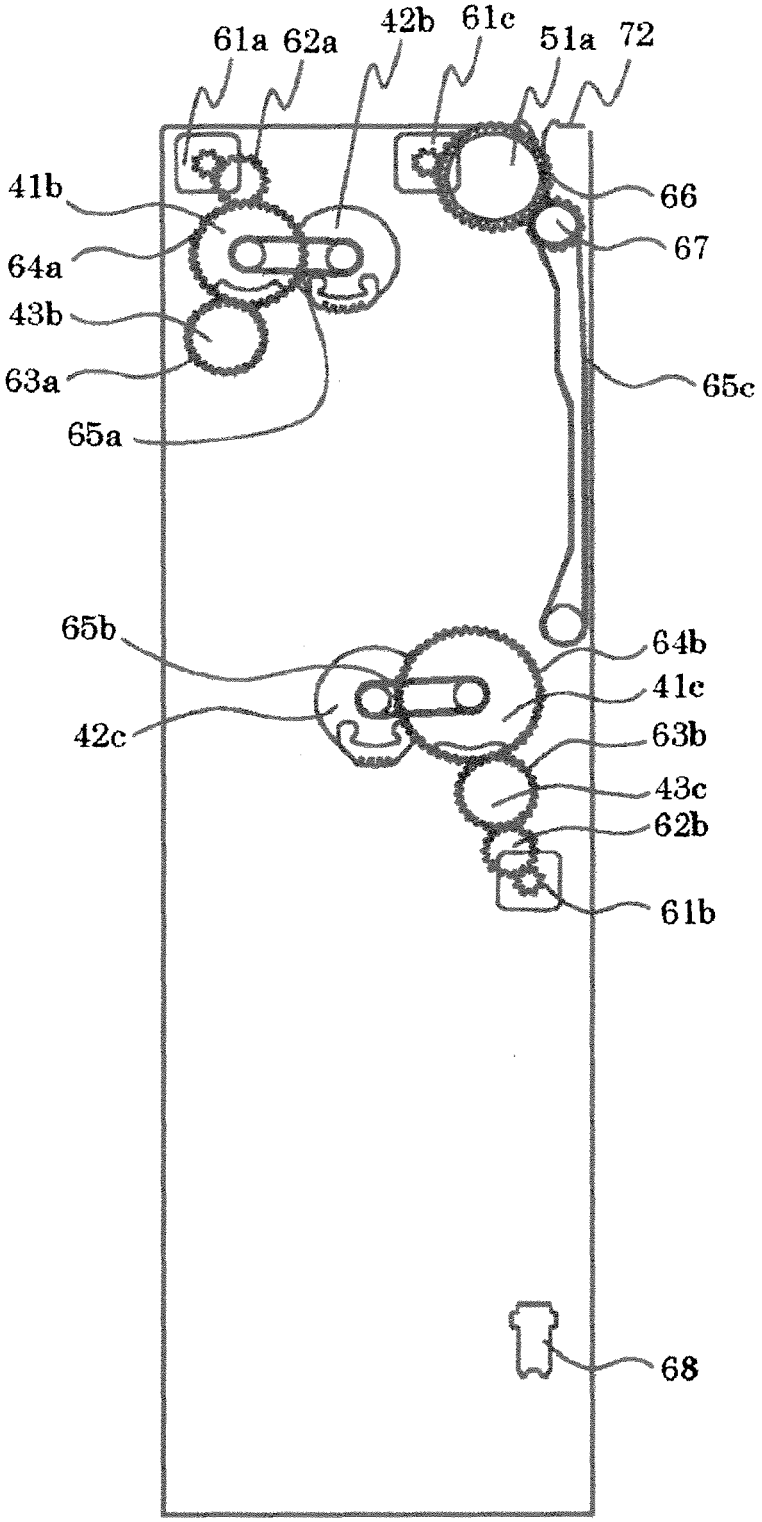
FIG. 10 is a side view showing a driving means of the bill storage having two receipt portions therein.

FIG. 10 is a view showing taking-out and accumulating operation parts, the roller 51*a*, and driving means of the conveyor belt 65*c*, which are provided on the upper receipt portion 700*b* and on the lower receipt portion 700*c*. Out of the taking-out and accumulating operation parts, driving is transmitted to the feed roller 41 (41*b*, 41*c*) and the gate roller 43 (43*b*, 43*c*) through a driving transfer gear 62 (62*a*, 62*b*), a driving transfer gear 63 (63*a*, 63*b*), and a driving transfer gear 64 (64*a*, 64*b*) from a DC motor 61 (61*a*, 61*b*). Also, driving is transmitted to the pickup roller 42 through the driving transfer gear 62 (62*a*, 62*b*), the driving transfer gear 64 (64*a*, 64*b*), and a timing belt 65 (65*a*, 65*b*) from the DC motor 61 (61*a*, 61*b*). Further, driving is transmitted to the roller 51*a* and the conveyor belt 65*c* through a driving transfer gear 66 and a driving transfer gear 67 from a DC motor 61*c*.

In addition, supplying of electricity to the DC motor and sending/receiving of electric signals by sensors (not shown) are conducted through a connector 68 provided on a lower portion of the bill storage 72.

Figure 11:
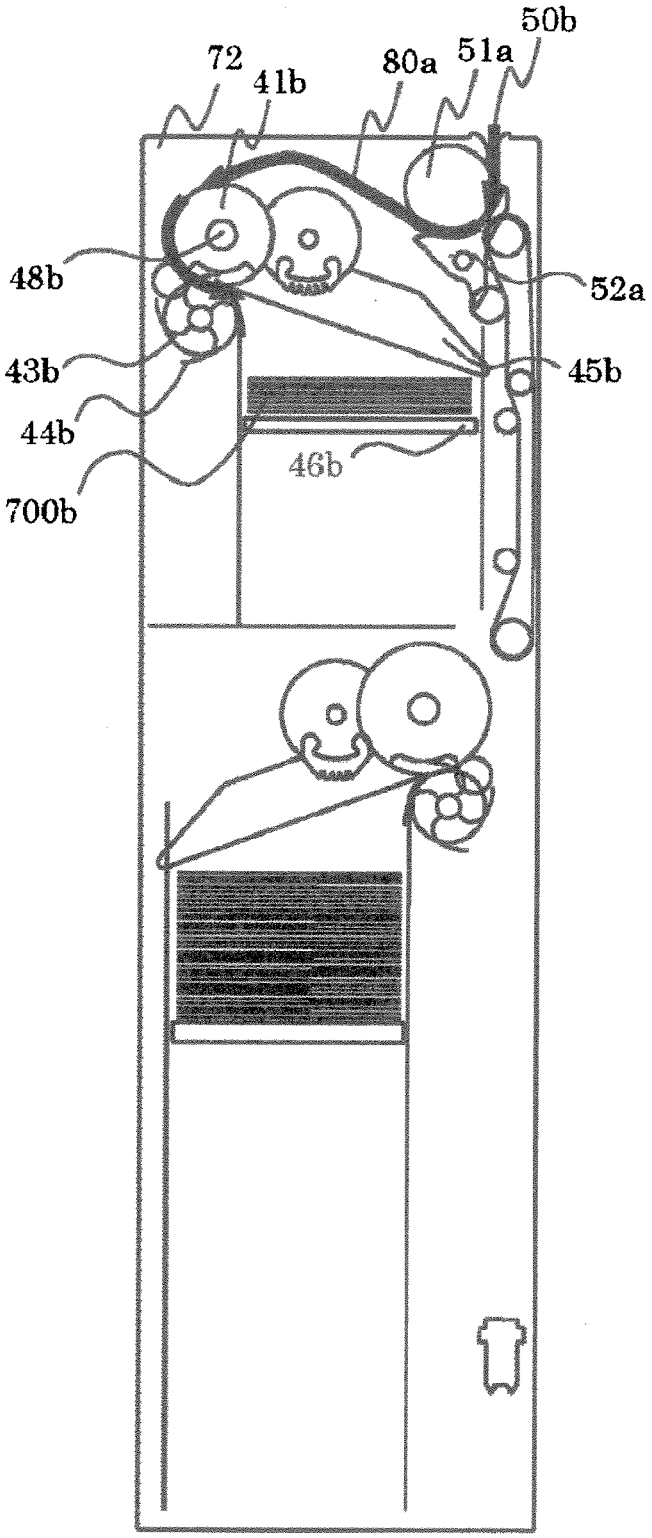
FIG. 11 is a side view showing an action, in which bills are accumulated in an upper receipt portion.

FIG. 11 is a view showing an action, in which bills are accumulated in the upper receipt portion 700*b*.

Bills conveyed into the bill storage 72 through the bill inlet-outlet 50*b* are conveyed onto the internal conveyance path 80*a* by the roller 51*a* and the sorting gate 52*a*. Thereafter, bills are changed in a direction of conveyance by the feed roller 41*b* in a manner to have both sides thereof turned over and discharged into the upper receipt portion 700*b*.

Here, before bills are discharged into the upper receipt portion 700*b*, the push plate 46*b* is moved by a driving force of the stepping motor 69*b* (not shown). The push plate 46*b* is controlled in moving in a direction, in which bills as stored descend, so as to ensure a space in the receipt portion. Subsequently, the stack guide 45*b* rotates pivotally about a feed roller shaft 48*b* and so the stack guide 45*b* is moved slantwise. The stack guide 45*b* is moved slantwise whereby bills discharged into the upper receipt portion 700*b* move along a slope of the stack guide 45*b*. Also, speed, at which bills are taken in by the feed roller 41*b*, is preferably greater than or equal to speed, at which bills are conveyed along the internal conveyance path 80*a*, and is made substantially equal thereto in this embodiment.

Figure 12:
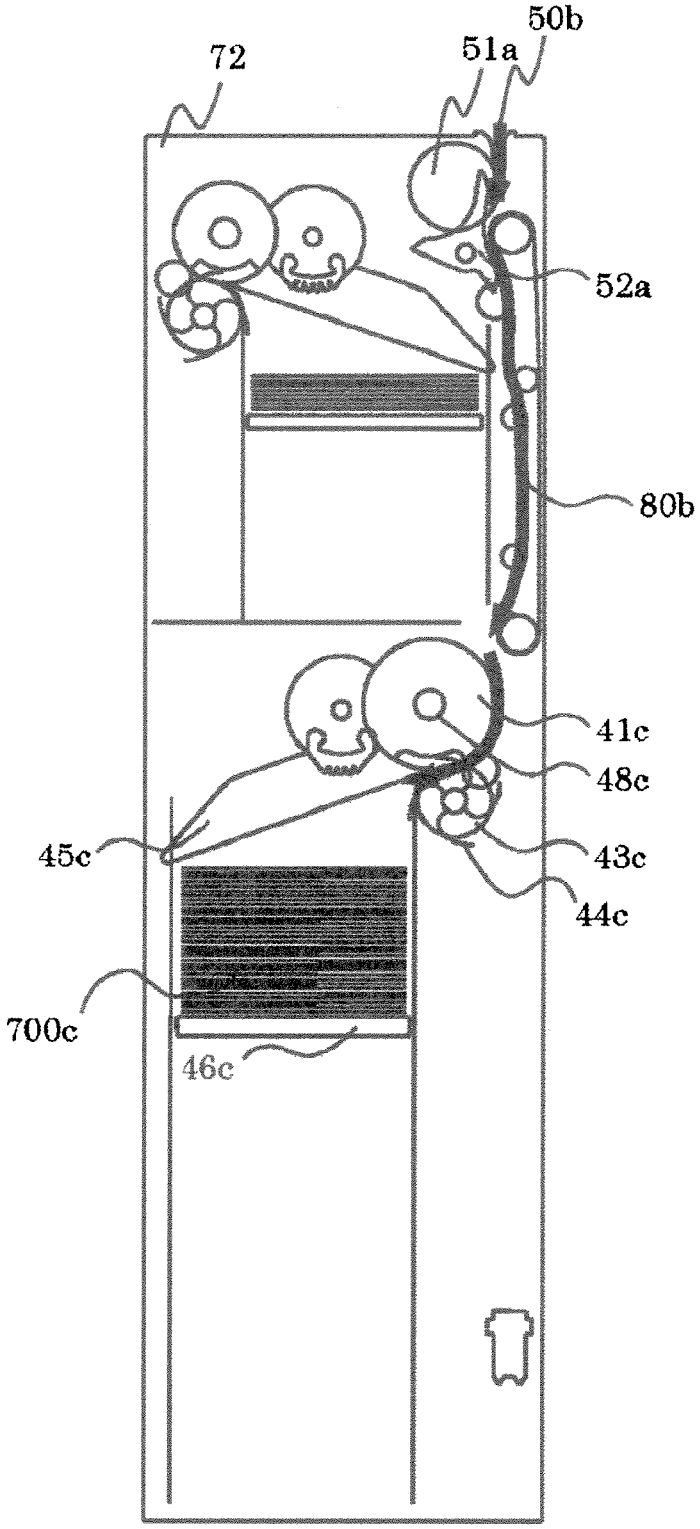
FIG. 12 is a side view showing an action, in which bills are accumulated in a lower receipt portion.

FIG. 12 is a view showing an action, in which bills are accumulated in the lower receipt portion 700*c*.

Bills conveyed into the bill storage 72 through the bill inlet-outlet 50*b* are conveyed onto the internal conveyance path 80*b* by the roller 51*a* and the sorting gate 52*a*. Thereafter, bills are discharged into the lower receipt portion 700*c* by the feed roller 41*c*.

Here, before bills are discharged into the lower receipt portion 700*c*, the push plate 46*c* is moved by a driving force of the stepping motor 69*c* (not shown). The push plate 46*c* is controlled in moving in a direction, in which bills as stored descend, so as to ensure a space in the receipt portion. Subsequently, the stack guide 45*c* rotates pivotally about a feed roller shaft 48*c* and so the stack guide 45*c* is moved slantwise. The stack guide 45*c* is moved slantwise whereby bills discharged into the lower receipt portion 700*c* move along a slope of the stack guide 45*c*. Also, speed, at which bills are taken in by the feed roller 41*c*, is preferably greater than or equal to speed, at which bills are conveyed along the internal conveyance path 80*b*, and is made substantially equal thereto in this embodiment.

Figure 13:
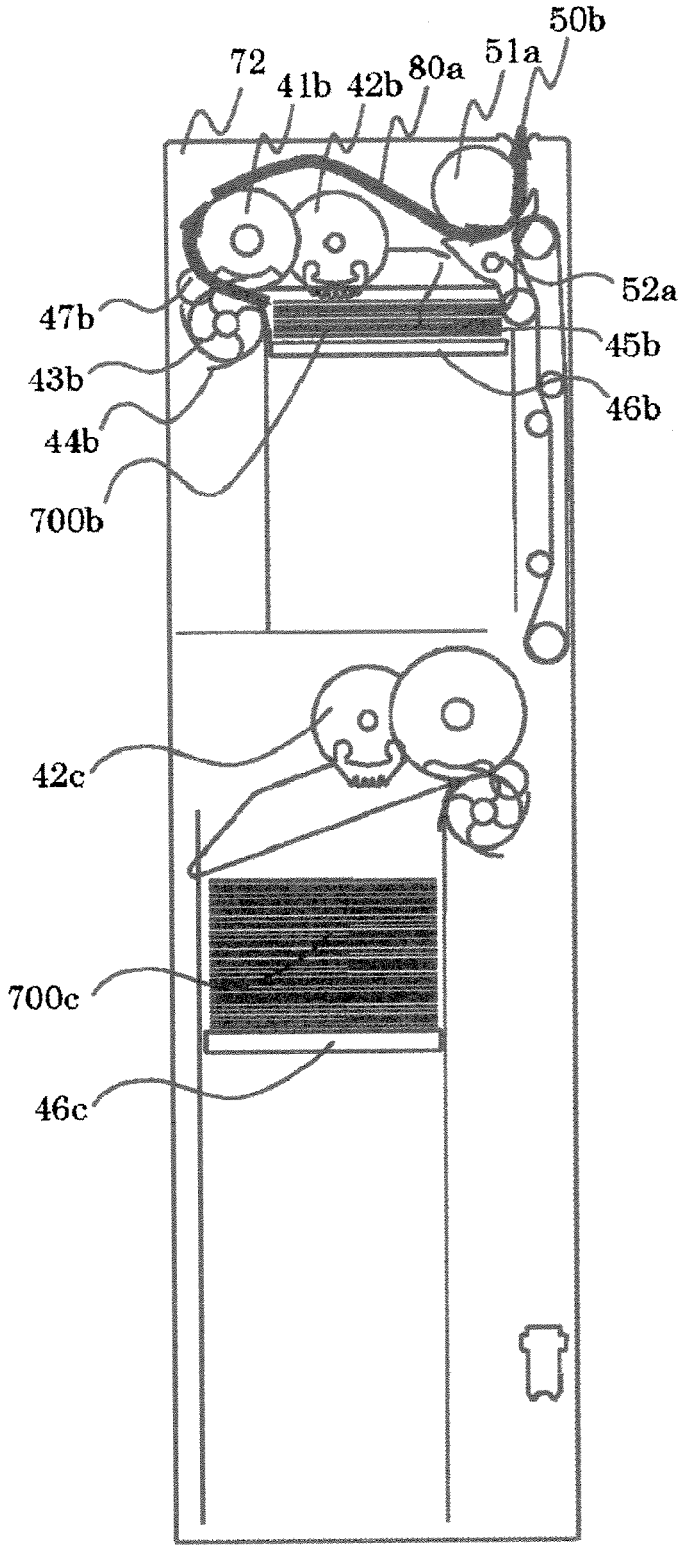
FIG. 13 is a side view showing an action, in which bills are taken out of the upper receipt portion.

FIG. 13 is a view showing an action, in which bills are taken out of the upper receipt portion 700*b*.

The push plate 46*b* is moved upward by a driving force of the stepping motor 69*b* (not shown). The push plate 46*b* is moved upward and so a force of a spring (not shown) or the like has bills on the stack guide 46*b* pushed against the pick-up roller 42*b* with a predetermined push force. On the other hand, within the lower receipt portion 700*c*, in a manner to prevent bills from being taken out, the pickup roller 42*c* causes the push plate 46*c* to descend to a position in no contact with bills in the lower receipt portion 700*c*.

Bills taken out of the upper receipt portion 700*b* by the pick-up roller 42*b* are forwarded by the feed roller 41*b*, which rotates, and while the gate roller 43*b*, which does not rotate in a taking-out direction, prevents two bills from being forwarded at once, bills are forwarded onto the internal conveyance path 80*a* through the pinch roller 47*b*. Thereafter, bills are conveyed one by one outside the bill storage from the bill inlet-outlet 50*b* by the roller 51*a* and the sorting gate 52*a*.

After a predetermined number of bills have been forwarded onto the internal conveyance path 80*a*, the feed roller 41*b* is stopped. Then, after all bills on the internal conveyance path 80*a* are conveyed outside the bill storage, the internal conveyance path 80*a* and the roller 51*a* are stopped.

Figure 14:
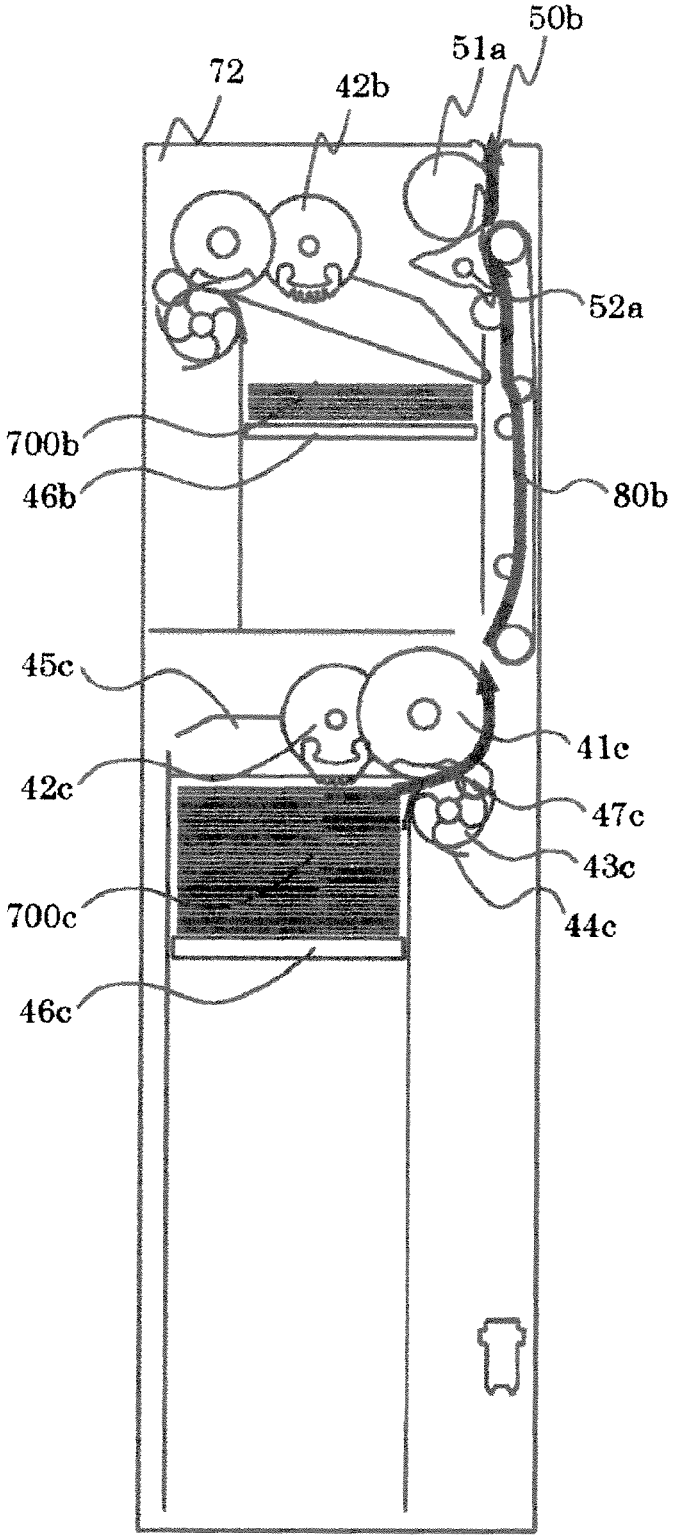
FIG. 14 is a side view showing an action, in which bills are taken out of the lower receipt portion.

FIG. 14 is a view showing an action, in which bills are taken out of the lower receipt portion 700*c*.

The push plate 46*c* is moved upward by a driving force of the stepping motor 69*c*. The push plate 46*c* is moved upward and so a force of a spring (not shown) or the like has bills on the push plate 46*c* pushed against the pickup roller 42*c* with a predetermined push force. On the other hand, within the lower receipt portion 700*b*, in a manner to prevent bills from being taken out, the pick-up roller 42*b* causes the push plate 46*b* to descend to a position in no contact with bills in the lower receipt portion 700*b*.

Bills pushed against the pick-up roller 42*c* are forwarded by the feed roller 41*c*, which rotates, and while the gate roller 43*c*, which does not rotate in a taking-out direction, prevents two bills from being forwarded at once, bills are forwarded onto the conveyance path 80*b*. Thereafter, bills are conveyed one by one outside the bill storage from the bill inlet-outlet 50*b* by the roller 51*a* and the sorting gate 52*a*.

After a predetermined number of bills have been forwarded onto the conveyance path 80*b*, the feed roller 41*c* is stopped. Then, after all bills on the conveyance path 80*b* are conveyed outside the bill storage, the conveyance path 80*b* and the roller 51*a* are stopped.

The respective bill storages 71, 72 in the bill handling apparatus constructed in a manner described above are constructed to be common to each other in outside dimension, in a position of the bill inlet-outlet (50*a*, 50*b*), in the shape of the bill inlet-outlet, and so on. Thereby, it is possible to provide interchangeability to the respective bill storages 71, 72, so that it is possible to freely change the combination of the bill storages 71, 72 to mount the same on the tray 110 according to the situation of application in respective countries.

For example, while bills circulated in Japan include four kinds of bill, that is, 10,000-yen note, 5,000-yen note, 2,000-yen note, and 1,000-yen note, application can be made such that 10,000-yen notes and 1,000-yen notes, which are large in amount of circulation, can be stored in the bill storage 71 provided therein with a single receipt portion and 5,000-yen notes and 2,000-yen notes, which are small in amount of circulation, can be stored together in the bill storage 72 provided therein with two receipt portions.

Next, a door, which is provided on the bill storage 72 in order to permit bills to be charged into and taken out of the upper receipt portion 700*b* and the lower receipt portion 700*c* will be described.

Figure 15:
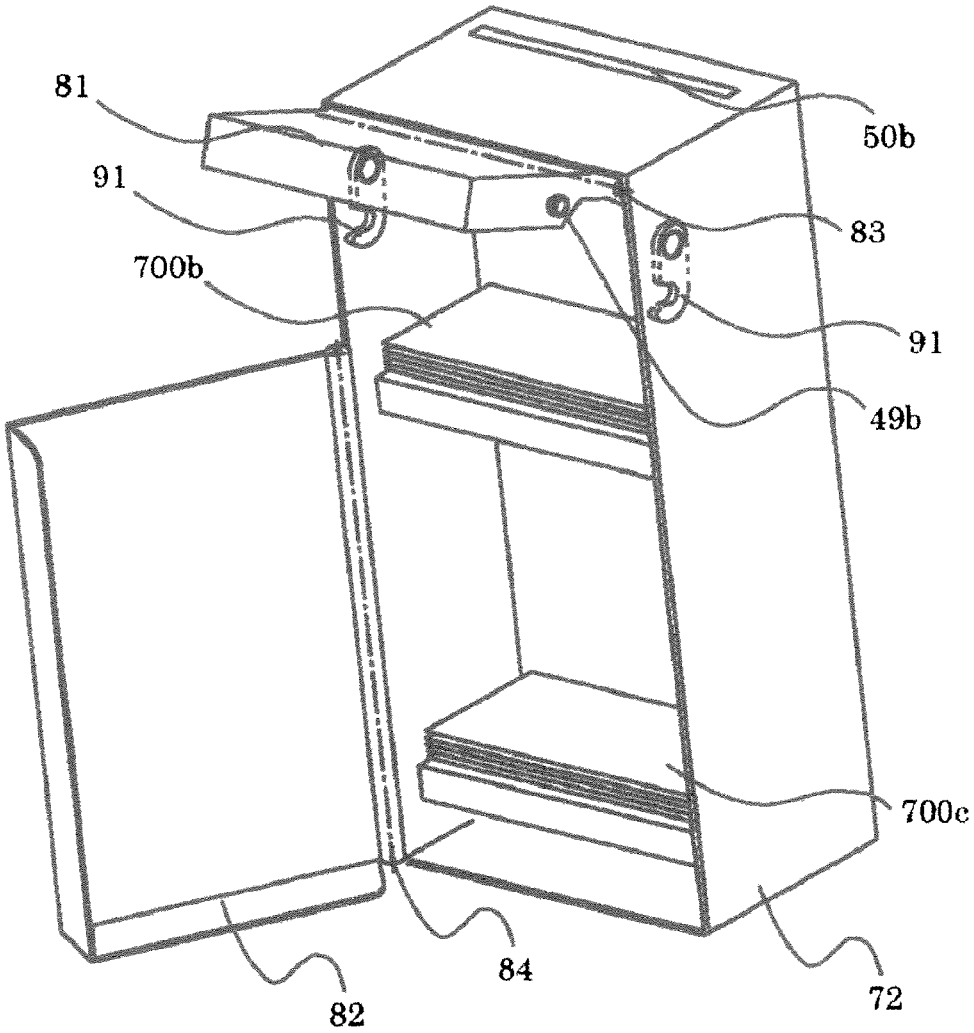
FIG. 15 is a perspective view showing an outline of a bill storage having two receipt portions therein.

FIG. 15 is a perspective view showing an appearance of the bill storage 72. The bill storage 72 is provided with an upper door 81, through which bills are charged into and taken out of the upper receipt portion 700*b*, and a lower door 82, through which bills are charged into and taken out of the bill receipt portion 700*c*. The upper door 81 and the lower door 82, which are provided on the back side of the bill storage, can be opened and closed independently of each other and enable bills to be charged into and taken out of the upper receipt portion 700*b* and the lower receipt portion 700*c* as need arises.

Also, the upper door 81 is constructed to turn about a rotating shaft 83 as a fulcrum to be opened and closed (referred below to as vertical opening), and the lower door 82 is constructed to turn about a rotating shaft 84, which is arranged at a corner of the bill storage 72, as a fulcrum to be opened and closed (referred below to as horizontal opening). That is the upper door 81 and the lower door 82 are different from each other in directions of opening and closing.

The reason why the upper door 81 adopts vertical opening will be described. Since the feed roller 43*b* and the stack guide 45*b* are interlocked with each other through the feed roller shaft 48*b*, the feed roller 41*b* is desirably left in the bill storage 72 irrespective of opening and closing of the upper door 81. Also, in the case where the gate roller 43*b* is disposed in the interior of the bill storage 72, it is difficult for a user to take in and out bills, so that it is desirable to interlockingly retreat the gate roller 43*b* and the upper door 81.

As described above, in the case where the feed roller 41*b* is left in the interior of the receipt box and the gate roller 43*b* is caused to interlock with the upper door 81, it is possible in tentatively horizontal opening of the upper door 81 that, for example, when errors are involved due to tolerance in design, secular change, or the like, the feed roller shaft 48*b* and a gate roller shaft 49*b* are made offset in a direction of intersection to cause an obstacle in conveyance of bill. On the other hand, in a construction, in which the upper door 81 adopts vertical opening, the problems described above are hard to occur even when errors are involved due to tolerance in design, secular change, or the like.

Figure 16:
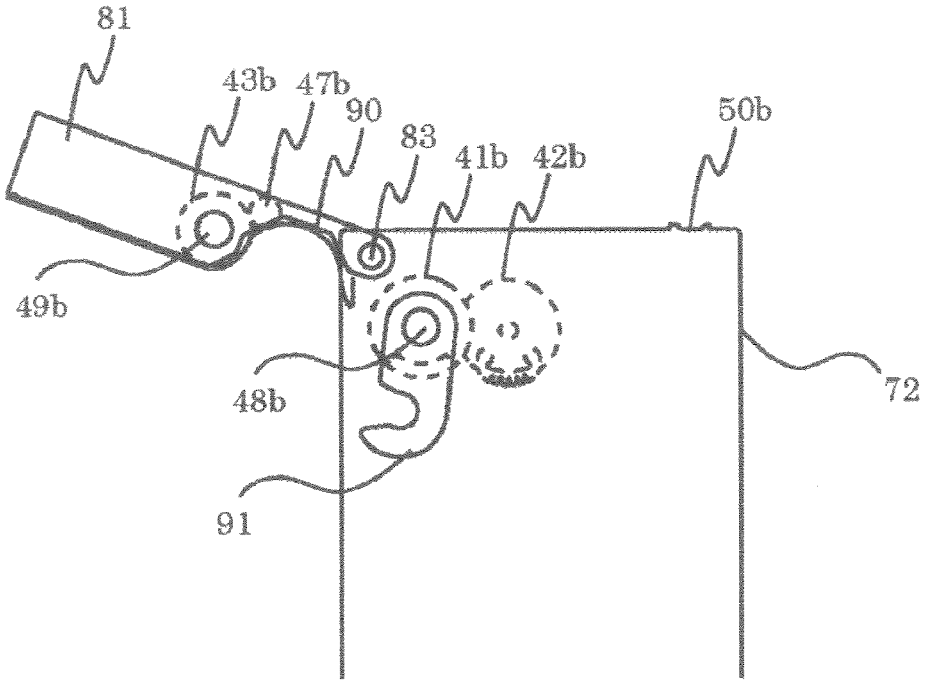
FIG. 16 is a side view showing the bill storage when an upper door is opened.
Figure 17:
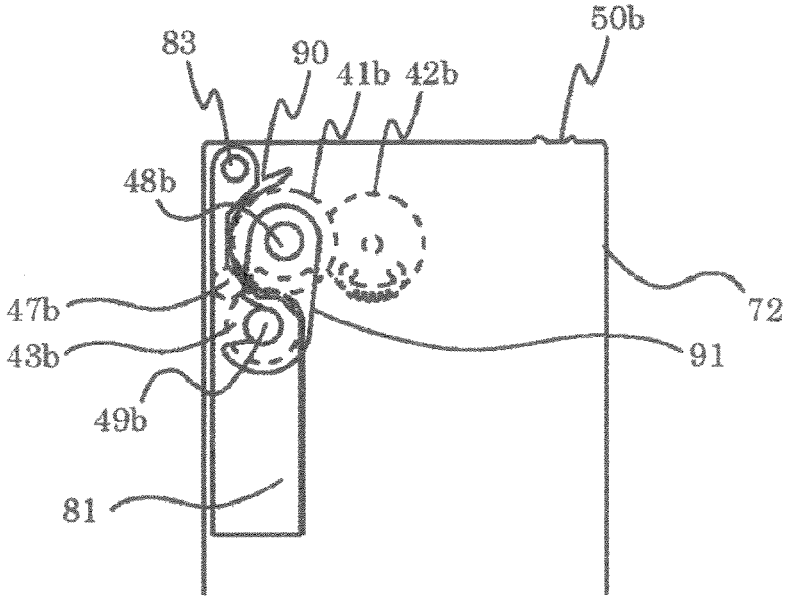
FIG. 17 is a side view showing the bill storage when the upper door is closed.

FIGS. 16 and 17 are views showing the bill storage 72 when the upper door 81 is opened and when the upper door 81 is closed. At this time, the gate roller 43*b*, the pinch roller 47*b*, and a conveyance guide 90 to the upper receipt portion 700*b* interlock with the upper door 81 to retreat, so that it is easy for a user to take in and out bills in loading and taking out bills.

Also, a shaft positioning plate 91 is arranged in two locations inside the bill storage 72 and outside the internal conveyance path 80*a* of bill. The shaft positioning plate 91 precisely fixes a center distance between the feed roller shaft 48*b* and the gate roller shaft 49*b*. In order to decrease a force required for opening and closing the door 82, a contact area between the shaft positioning plate 91 and the gate roller shaft 49*b* is made a necessity minimum to an extent capable of interposition of the gate roller shaft 49*b*.

Figure 18:
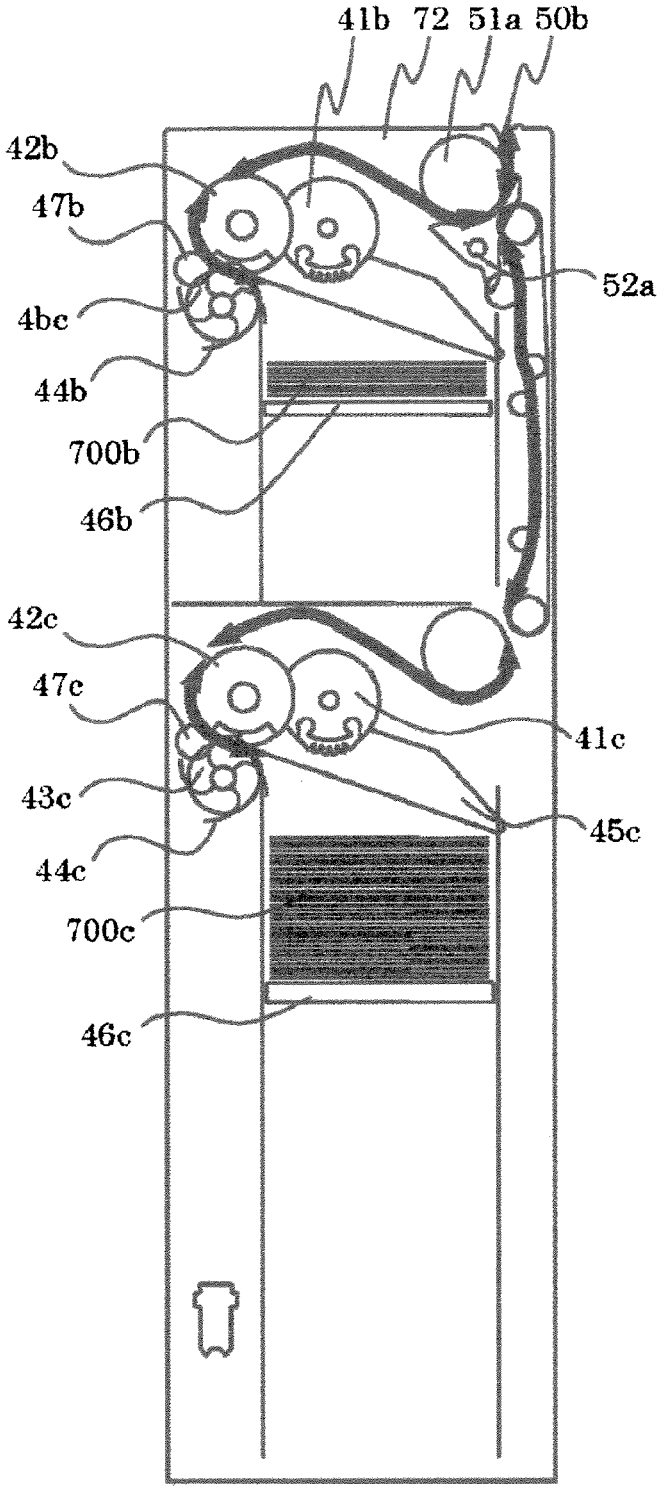
FIG. 18 is a side view showing a bill storage having two receipt portions therein (another embodiment)

In addition, in the embodiment described above, the taking-out and accumulating mechanism part (41*c* to 45*c*) provided in the lower receipt portion 700*c* is arranged substantially vertically downwardly of the bill inlet-outlet 50*b*, but it may be arranged substantially vertically downwardly of the taking-out and accumulating mechanism part (41*b* to 45*b*) provided in the upper receipt portion 700*b* as shown in FIG. 18.

Figure 19:
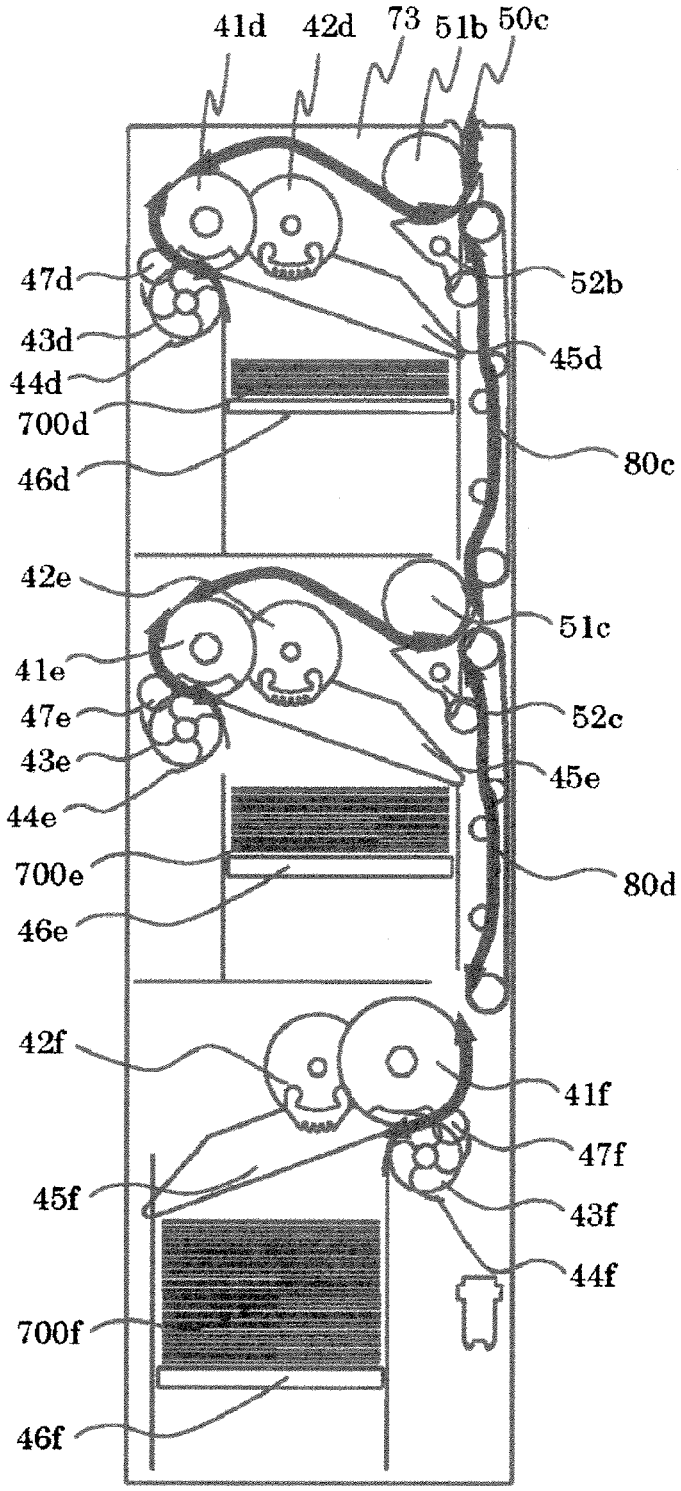
FIG. 19 is a side view showing a bill storage having three receipt portions therein.

Also, as shown in FIG. 19, the bill storage may have three receipt portions therein. With the bill storage 73, which has three receipt portions therein, a taking-out and accumulating mechanism part (41*d* to 45*d* (41*e* to 45*e*)) provided in an upper receipt portion 700*d* (an intermediate receipt portion 700*e*) is arranged on a side horizontally opposed to a bill inlet-outlet 50*c*, a sorting gate 52*b* (52*c*), and an internal conveyance path 80*c* (80*d*) with an upper receipt portion 700*d* (an intermediate receipt portion 700*e*) therebetween.

By adopting the construction described above, a width of a bill storage, which has a plurality of receipt portions therein, in a longitudinal direction can be made as substantially small as that of a bill storage provided therein with a single receipt portion, which stores therein only one denomination. Also, by optionally selecting a bill storage, which has a plurality of receipt portions therein, or a bill storage, which has a single receipt portion therein, to mount the same on the tray 110, it is possible to provide a bill handling apparatus, which can flexibly conform to the situation of application in respective countries.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A bill storage comprising:

a plurality of bill receipt portions provided therein;

a bill inlet-outlet, which is provided on an upper surface of the bill storage and through which bills are taken out or received from outside; and a taking-out and accumulating mechanism part provided on each of the receipt portions to perform actions, in which bills are taken out and in which bills are accumulated, wherein at least a first bill receipt portion and a second bill receipt portion are arranged in a state of being stacked in this order from a side of the bill inlet-outlet, said bill inlet-outlet is provided on a predetermined side, said taking-out and accumulating mechanism part provided on the first bill receipt portion is arranged on another side opposed to said predetermined side, a door, through which bills in the respective bill receipt portions are charged and taken out, is provided on said another side; and a direction of opening and closing of the door, through which bills in the first bill receipt portion are charged and taken out, and a direction of opening and closing of that door, through which bills in the second bill receipt portion are charged and taken out, are different from each other.

2. The bill storage according to claim 1, further comprising a plurality of internal conveyance paths, through which bills are conveyed bidirection between the bill inlet-outlet and the respective receipt portions, the plurality of internal conveyance paths comprising a first internal conveyance path, through which bills are conveyed substantially in a horizontal direction, and a second internal conveyance path, through which bills are conveyed substantially in a vertical direction, and the second internal conveyance path being provided on said predetermined side.

3. The bill storage according to claim 2, characterized in that wherein bills conveyed to the first internal conveyance path are received in the first bill receipt portion with front and back sides thereof reversed.

4. The bill storage according to claim 2, characterized in that bills conveyed to the first internal conveyance path are received horizontally in the first bill receipt portion.

5. The bill storage according to claim 1, characterized in that the respective taking-out and accumulating mechanism parts are provided individually with drive means for driving the taking-out and accumulating mechanism parts.

6. The bill storage according to claim 1, characterized in that the taking-out and accumulating mechanism parts comprise at least a feed roller, which rotates in a bill accumulating action and a bill taking-out action to convey bills and a gate roller, which rotates in the bill accumulating action but does not rotate in the bill taking-out action.

7. The bill storage according to claim 1, characterized in that the gate roller on the first taking-out and accumulating mechanism part moves together with the door, through which bills in the first bill receipt portion are charged and taken out.

8. A bill handling apparatus comprising:

a bill receipt and payment port, at which bill receipt and payment by a user are permitted;

a bill discrimination unit, which discriminates bills being received or paid;

a conveyance path, through which bills are conveyed; and a mounting portion, on which the bill storage according to claim 1 is mounted, the mounting portion being constructed so that a bill storage provided with only one bill receipt portion having a taking-out and accumulating mechanism part, which performs actions, in which bills are taken out and in which bills are accumulated and the bill storage according to claim 1 are optionally selected and mounted.

9. The bill storage according to claim 1, further comprising a sorting gate, by which conveyance of bill between the bill inlet-outlet and the first bill receipt portion and conveyance between the bill inlet-outlet and the second bill receipt portion are switched, the sorting gate being arranged on said predetermined side.

10. A bill storage comprising:

a plurality of bill receipt portions provided therein;

a bill inlet-outlet which is provided on an upper surface of the bill storage and through which bills are taken out or received from the outside; and a plurality of internal conveyance paths, through which bills are conveyed bidirection between the bill inlet-outlet and the respective bill receipt portions, wherein at least a first bill receipt portion and a second bill receipt portion are arranged in a state of being stacked in this order from a side of the bill inlet-outlet, characterized in that the first bill receipt portion is arranged offset toward a predetermined side, and the second bill receipt portion is arranged offset toward another side opposed to the predetermined side;

a door, through which bills in the respective bill receipt portions are charged and taken out, is provided on said another side, and a direction of opening and closing of the door, through which bills in the first bill receipt portion are charged and taken out, and a direction of opening and closing of that door, through which bills in the second bill receipt portion are charged and taken out are different from each other.

* * * * *